US010979792B2

(12) United States Patent
Calisi et al.

(10) Patent No.: US 10,979,792 B2
(45) **Date of Patent: *Apr. 13, 2021**

(54) WIRELESS SOUND-EMITTING DEVICE AND SYSTEM FOR REMOTELY CONTROLLING A SOUND-EMITTING DEVICE

(71) Applicant: Cambridge Sound Management, Inc., Waltham, MA (US)

(72) Inventors: Christopher Calisi, Waltham, MA (US); Gordon V. Cook, Acton, MA (US); Edward Driscoll, Westwood, MA (US); Thomas R. Horrall, Harvard, MA (US)

(73) Assignee: CAMBRIDGE SOUND MANAGEMENT, INC., Waltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/660,663

(22) Filed: Oct. 22, 2019

(65) Prior Publication Data

US 2020/0053447 A1 Feb. 13, 2020

Related U.S. Application Data

(63) Continuation of application No. 15/928,227, filed on Mar. 22, 2018, now Pat. No. 10,455,307, which is a (Continued)

(51) Int. Cl.
*H04R 1/02* (2006.01)
*H04R 3/00* (2006.01)

(Continued)

(52) U.S. Cl.
CPC ..... *H04R 1/028* (2013.01); *G10K 11/175* (2013.01); *H04K 3/825* (2013.01); *H04K 3/84* (2013.01);

(Continued)

(58) Field of Classification Search
CPC . H04R 3/00; H04R 1/028; H04R 1/06; H04R 2420/07; H04R 2201/021;

(Continued)

(56) References Cited

U.S. PATENT DOCUMENTS 4,052,564 A 10/1977 Propst et al.
4,476,572 A 10/1984 Horrall et al.

(Continued)

FOREIGN PATENT DOCUMENTS

JP 2005005334 A 1/2005
JP 2012247698 A 12/2012

(Continued)

OTHER PUBLICATIONS

Broida; CNET Article "Fund this Smart earplugs promise a better night's sleep"; Nov. 25, 2014; pp. 1-5.
Holm; Wired Article "How do I sleep at night"; Nov. 18, 2014; pp. 1-6.

*Primary Examiner* — Brenda C Bernardi

(57) ABSTRACT

A wireless sound-emitting device includes a housing adapted to be coupled to a wall at a source of electric power, a loudspeaker positioned at a periphery of the housing, a control module outputting an electric audio signal to the at least one loudspeaker, and a wireless communications module in electrical communication with the control module. The loudspeaker emits acoustic signals in a direction parallel to the wall, when the housing is coupled to the wall, with the acoustic signals reflecting off the wall. The device may produce a sound masking noise or play a sound recorded on an internal memory. The device may include an electric plug or be adapted to replace an electric outlet faceplate. The device may have electric pass-through outlets and may be powered by the source of electric power. The device may be controlled remotely, for example via an Internet of Things (IoT) platform.

20 Claims, 8 Drawing Sheets

Related U.S. Application Data continuation of application No. 15/423,029, filed on Feb. 2, 2017, now Pat. No. 9,955,245, which is a continuation of application No. 14/985,879, filed on Dec. 31, 2015, now Pat. No. 9,596,539.

(60) Provisional application No. 62/219,536, filed on Sep. 16, 2015.

(51) Int. Cl.

| | |
|---|---|
| ***H04K 3/00*** | (2006.01) |
| ***G10K 11/175*** | (2006.01) |
| ***H04R 1/06*** | (2006.01) |

(52) U.S. Cl.

CPC ..... *H04R 3/00* (2013.01); *H04K 2203/12* (2013.01); *H04K 2203/34* (2013.01); *H04R 1/06* (2013.01); *H04R 2201/021* (2013.01); *H04R 2227/005* (2013.01); *H04R 2420/07* (2013.01)

(58) Field of Classification Search

CPC .... H04R 2227/005; H04K 3/825; H04K 3/84; H04K 2203/12; H04K 2203/34; G10K 11/175

See application file for complete search history.

(56) References Cited

U.S. PATENT DOCUMENTS

| | | | |
|---|---|---|---|
| 6,188,771 | B1 | 2/2001 | Horrall |
| 6,377,172 | B1 | 4/2002 | Neer |
| 6,888,945 | B2 | 5/2005 | Horrall |
| 7,194,094 | B2 | 3/2007 | Horrall et al. |
| 8,098,834 | B1 | 1/2012 | O'Shea et al. |
| 8,660,581 | B2 | 2/2014 | Davis et al. |
| 8,705,756 | B1 | 4/2014 | O'Shea et al. |
| 8,761,411 | B2 | 6/2014 | Zickmantel |
| 9,076,430 | B2 | 7/2015 | Horrall et al. |
| 9,596,539 | B1 | 3/2017 | Calisi et al. |
| 9,955,245 | B2 | 4/2018 | Calisi et al. |
| 2003/0097501 | A1 | 5/2003 | Young |
| 2007/0092088 | A1 | 4/2007 | Chang |
| 2010/0322455 | A1 | 12/2010 | Carlson |
| 2016/0372959 | A1 | 12/2016 | Faerber |
| 2017/0048312 | A1 | 2/2017 | Moyer |
| 2017/0078789 | A1 | 3/2017 | Calisi et al. |

FOREIGN PATENT DOCUMENTS

| | | | |
|---|---|---|---|
| WO | 2008076338 | A1 | 6/2008 |
| WO | 2009067669 | A1 | 5/2009 |
| WO | 2013192135 | A1 | 12/2013 |
| WO | 2015127402 | A1 | 8/2015 |

WIRELESS SOUND-EMITTING DEVICE AND SYSTEM FOR REMOTELY CONTROLLING A SOUND-EMITTING DEVICE

BACKGROUND

The acoustic environment of a room is an important consideration for any occupied space. The ability to manage a room's acoustic environment is a consideration in many aspects of the design of residential, commercial and industrial structures. For example, freedom from distraction is an important consideration in workers' satisfaction with their office environment and in homeowners' enjoyment of their private space. Beyond physical changes to a room or structure, many solutions exist for providing a desirable acoustic characteristic, such as sound masking systems to reduce the intelligibility of unwanted speech overheard in various office configurations.

However, there is a need to increase the flexibility of placement and ease-of-installation of sound masking and sound-emitting systems; to increase the usage of sound masking systems in setting other than offices; to improve their aesthetic appearance and integration with other systems in environments in which they are used; and/or to improve other characteristics of sound masking systems.

SUMMARY OF THE INVENTION

An example embodiment of the present invention is a wireless sound-emitting device having a housing adapted to be coupled to a wall at a source of electric power, a loudspeaker positioned at a periphery of the housing, and a control module outputting an electric audio signal to the loudspeaker, the electric audio signal drives the loudspeaker and the loudspeaker converts the electric audio signal into emitted acoustic signals. The loudspeaker is adapted to emit acoustic signals in a direction parallel to the wall when the housing is coupled to the wall. The wireless sound-emitting device includes a wireless communications module in electrical communication with the control module. The wireless sound-emitting device may have two or more loudspeakers, with the control module driving the two or more loudspeakers in stereo. The control module may be adapted to be powered by the source of electric power.

In some embodiments, the housing includes an acoustic enclosure acoustically coupled to the rear end of loudspeakers. In some embodiments the acoustic enclosure is a sealed or ported enclosure. The loudspeaker may have a small diameter, such as a largest aperture dimension of less than about 3 centimeters, and the housing may include a protective grille covering the loudspeaker.

In one embodiment, the wireless sound-emitting device includes a front face having at least one electric socket, and a rear face having at least one corresponding electric plug. The at least one electric plug may be configured to pass-through an electric power signal to the at least one corresponding electric plug, and the control module may receive power from the at least one electric plug.

In another embodiment, the wireless sound-emitting device is incorporated into a wall-plate adapted to be secured to an electric back-box in the wall, the electric back-box having the source of electric power.

The wireless sound-emitting device may include one or more status indicator lights, with each of the status indicator lights being responsive to a status of one or more of: the loudspeaker, the control module, the source of electric power, the control module, and the wireless communications module.

In some embodiments the wireless sound-emitting device includes a memory module in electrical communication with the processor module. The memory module may store digital sound files. The control module can convert the digital sound files into corresponding analog electronic signals and drive the at least one loudspeaker with the corresponding analog electronic signals to emit acoustic signals based on the corresponding analog electronic signals. The wireless communications module may be adapted to wirelessly receive digital sound data and the memory module may store the digital sound data transmitted to the device through the wireless communication module.

In some embodiments the control module is adapted to output a sound-masking signal to the loudspeaker, with the at least one loudspeaker emitting a corresponding masking sound in a direction parallel to the wall.

Another example embodiment of the present invention is a system for managing the sound environment of one or more rooms including at least one wireless sound-emitting device according to aspects of the present invention, and a wireless controller adapted to be in wireless communication with each sound-emitting device, the wireless controller enabling remote control of the at least one wireless sound-emitting device.

The wireless controller may include an application program interface (API) to communicate electronically with a smart home system, with the API enabling the smart home system to control operation of the at least one wireless sound-emitting device. The wireless controller enables remote control of at least one of the following of the wireless sound-emitting device: volume of the at least one loudspeaker, turning the device on or off, selection of an sound or audio file to be played, turning on or off emitting of a sound masking sound, and scheduling of operation of the wireless sound-emitting device.

In some embodiments, the wireless controller includes a microphone to record a spoken paging address, and the wireless controller streams the recording to the wireless sound-emitting devices to cause one or more of the devices' loudspeakers to emit the paging address.

The wireless controller may be a portable computer device running an application for user controlling the operation of the at least one wireless sound-emitting device. The application may provide a user interface on a display screen of the portable computer device.

In further embodiments, the wireless controller may be adapted to enable remote control of the at least one wireless sound-emitting device from a customer portal. The wireless controller may be adapted to enable remote control of the at least one wireless sound-emitting device via an Internet of Things platform; and the wireless controller may be adapted to enable communication of the at least one wireless sound-emitting device with at least one other Internet of Things device via the Internet of Things platform

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

Figure 1:
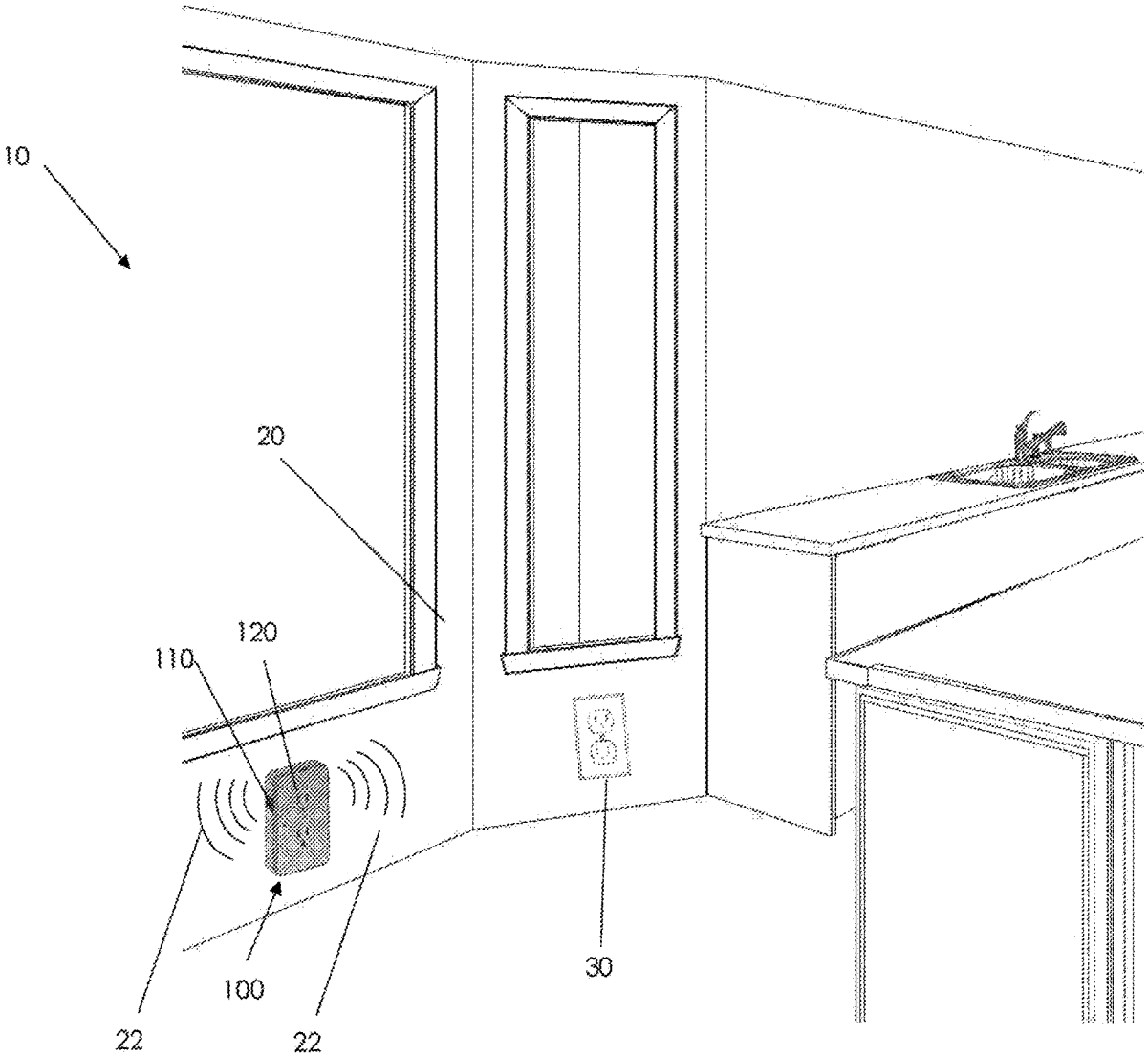
FIG. 1 is an illustration of a wireless sound-emitting device in a residential environment in an embodiment according to the present invention.

A description of example embodiments of the invention follows.

An embodiment according to the invention relates to a sound-emitting system that can be used in buildings (including single- and multi-unit residential buildings and commercial buildings) for masking intrusive sound, such as outside road noise, for example to assist with sleep quality; or for producing a desired sound to modify the acoustic environment in a room. For example, an embodiment according to the invention can enable bedroom occupants to sleep with fewer distractions and interruptions by wirelessly selecting a specific sound stream to be emitted into the room. The system involves user-installable sound emitter units that replace, or connect to, conventional wall power outlets, and that communicate wirelessly with a wireless controller, which may include an application running on a tablet or smartphone device, from which the individual sound emitter units are controlled. The sound emitter units can include pass-through outlets so that the underlying power outlets can still be used for AC-power, and can emit sound laterally out of the sides of the sound emitter units, along the wall surfaces that surround the sound emitter units. Alternatively, the emitter unit can be configured to replace the front plate of an electric back-box and enable a user to install the emitter units by modifying existing wall outlets without losing access to the outlets.

In an embodiment according to the invention, the sound emitter unit includes an internal processor mounted on an integrated circuit board, which can, for example, run software including an operating system, such as Linux; and has sound emitters to emit sound laterally. Each sound emitter unit communicates wirelessly (typically over WiFi or Bluetooth) with the wireless controller. The sound emitter unit can be installed into the wall outlet by the user, for example by a consumer, using a conventional screw. For example, one to three sound emitters can be installed per room in a residential building. As noted above, the sound emitter unit can function as a pass-through outlet to allow the wall outlet to be used for AC-power; and can include power outlets, such as two 3-prong outlets or another number or format of power outlets. The sound emitter unit can, for example, include an indicator light, which function as a night light among other things, and a mute button. The fact that sound is emitted laterally from a low-profile sound emitter unit, to be reflected off the surrounding wall, enables increased reflection off the room and reduces sound localization. The sound emitters can be small cone-shaped loudspeakers with driver coils; and can include small resonant sound chambers within the sound emitter unit. There can, for example, be two loudspeakers per sound emitter unit, one on each side, and operating in stereo. The sound emitter units can include a microphone for audio-in, for example to allow use of the sound emitter units as intercoms or for paging. The sound emitter units can themselves perform paging based on signals from the wireless controller, as discussed further below.

In an embodiment according to the invention, the wireless controller can provide control instructions to the sound emitter units, including which sounds to play, whether to be on or off, and how fast to ramp-up to full sound volume. All settings can be adjusted from the wireless controller. The sound emitter units can be controlled by areas within a dwelling (e.g. an east wing or west wing of an apartment or hotel), by user groups, by rooms, and by the individual device. The software for the wireless controller can be downloaded, for example as a software application for the wireless controller, such as an "app" for a tablet device, smartphone, other mobile device or other wireless controller.

In an embodiment according to the invention, the sounds played by the sound emitter units can include dedicated "sound masking" signals (which use a sound masking spectrum), in order to mask outside noise such as road noise or, in some cases, human speech; or merely sounds that provide a pleasant ambience, such as rain forest noise, bird sounds, surf, and other pleasing sounds. The sounds can be stored as a selection of digital audio files on the sound emitter units, for example, digital audio files in a WAV-format (.wav) or other digital audio file format; or the sound files can be transmitted through streaming from the wireless controller to the sound emitter units. In another embodiment according to the invention, a wireless sound-emitting device can be controlled remotely, via a customer portal, through an Internet of Things (IoT) platform.

FIG. 1 is an illustration of a wireless sound-emitting device in a residential environment in an embodiment according to the present invention. FIG. 1 shows a room 10 in a residential building. Room 10 can also be, for example, in a commercial building or any other occupied structure. Room 10 includes a wall 20 having an electrical outlet 30, which may, for example, be a standard size 110V three-prong outlet or another number or format of power outlet. A wireless sound-emitting device 100 is affixed to the wall 20. The wireless sound-emitting device 100 includes a three-prong outlet 120 (or other type of outlet) on a front-face and a sound-emitting mechanism, preferably a loudspeaker (not shown), behind a protective grille 110. The wireless sound-emitting device 100 can be affixed to the wall 20 by way of a standard three prong 110 V plug (on a rear-face, not shown; or other type of plug) coupled with a corresponding electric outlet, such as an outlet similar to electric outlet 30, on the wall 20, or, in an alternate embodiment, the sound-emitting device 100 can be directly connected to an electric back-box in the wall 20. In this manner, the sound-emitting device 100 can be configured to removably connect to a standard electric outlet 30 or replace the front-plate of an electric outlet 30.

In an embodiment according to the invention, the wireless sound-emitting device 100 can include a wireless receiver, digital processor, and digital memory (not shown) and can be configured to receive operational commands from a wireless controller (not shown), which can include, for example, one or more of: volume adjustment, instructions to play a digital sound file stored in the digital memory, instructions to play a sound-masking noise, instructions for advance scheduling of emission of sound, and instructions to play streaming audio data sent wirelessly to the sound-emitting device 100.

In operation of an embodiment according to the invention, the wireless sound-emitting device 100 emits, from behind the protective grille 110 (with loudspeakers, not shown) acoustic signals 22 in a direction that faces sideways out of the device 100, i.e. in a direction that is oriented laterally across the surface of the wall 20. The acoustic signals 22 emitted from the wireless sound-emitting device 100 can be used to create a sound environment in the room 10, which can include, for example, pleasant background noises stored in the digital memory, such as birds chirping or, rain falling. The wireless sound-emitting device 100 can also be used to produce a sound-masking noise, which can be used to, for example, reduce the distraction caused by noises that are internal or external to the room 20, e.g., car traffic or human speech. For an acoustic sound masking signal, a sound masking system in accordance with an embodiment of the invention can use a sound masking spectrum based on the principles of the spectrum described in L. L. Beranek, "Sound and Vibration Control," McGraw-Hill, 1971, Page 593, the teachings of which reference are incorporated by reference in their entirety. The low end frequencies of the selected spectrum preferably comprise at least one of 50 Hz, 80 Hz and 100 Hz, most preferably 80 Hz. The high end frequencies are preferably less than 8 kHz and more preferably about 5300 Hz or less. It will be appreciated that other sound masking spectra can be used. In some embodiments, the wireless sound-emitting device 100 can function as a paging loudspeaker system, in connection with a suitable wireless controller having a microphone (not shown, and which may be the wireless control device 680 of FIG. 6), and play a paging address in the room 20 spoken into the microphone of the wireless controller.

Figure 2A:
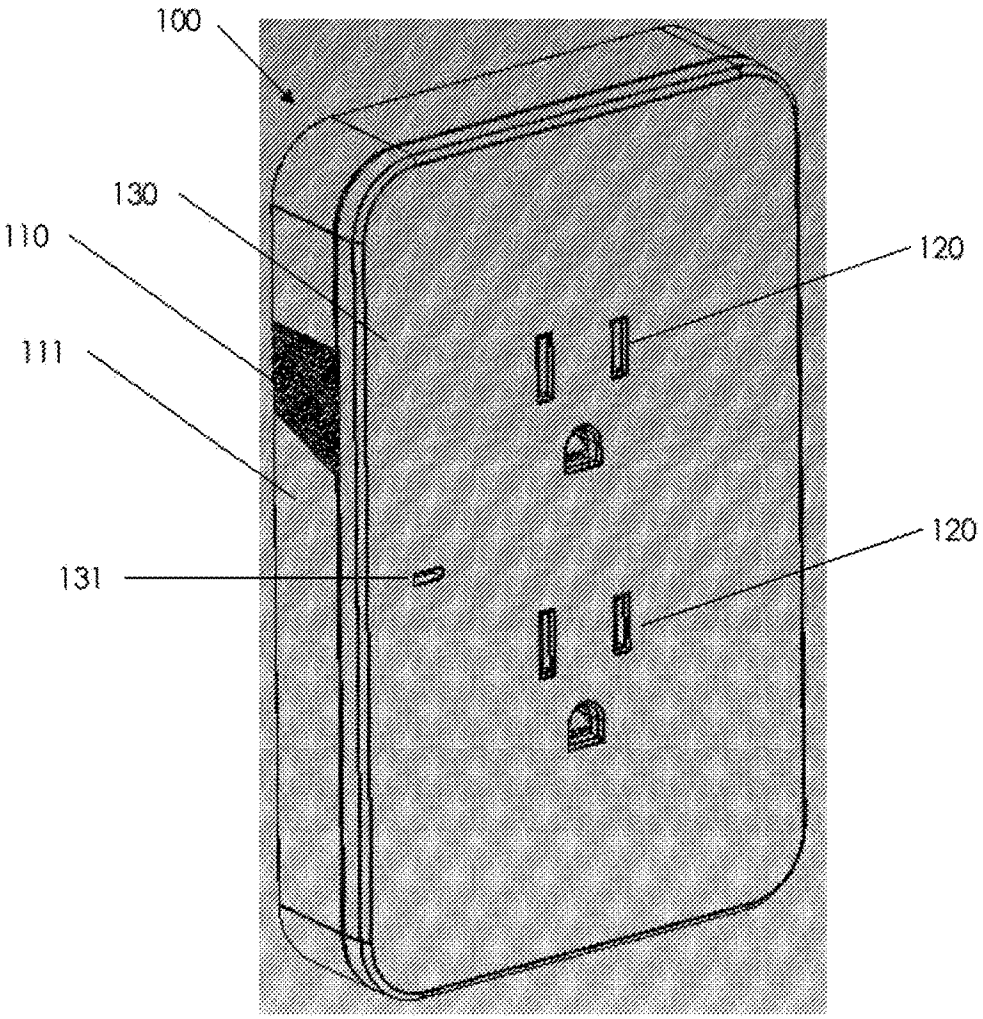
FIGS. 2A-B are front and rear isometric view illustrations, respectively, of a wireless sound-emitting device embodiment.
Figure 2B:
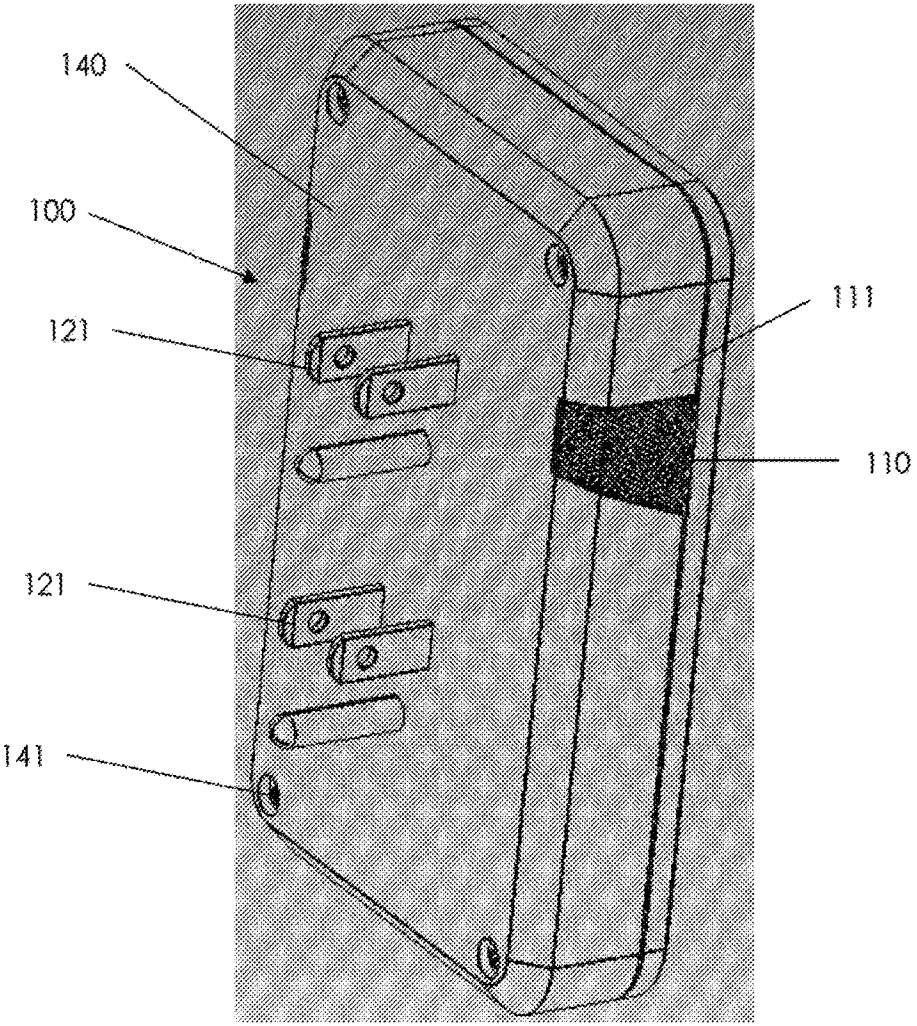

FIGS. 2A-B are front and rear isometric view illustrations, respectively, of a wireless sound-emitting device embodiment. FIG. 2A shows the wireless sound-emitting device 100 of FIG. 1 in more detail. The wireless sound-emitting device 100 includes a front face 130 having two standard three prong electric outlets 120 (or another number or format of power outlets) and a status light 131. The wireless sound-emitting device 100 includes a housing having a peripheral face 111, which includes a protective grille 110 positioned in front of a loudspeaker (not shown). The wireless sound-emitting device can have one or more loudspeakers behind the protective grille 110, and can also have multiple grilles positioned around the peripheral face 111 to emit sound waves (that is, the acoustic signals emitted by the loudspeakers) across the wall 20 in multiple directions that extend laterally from the device 100, across the surface of the wall 20.

In operation of an embodiment according to the invention, the three-prong electric outlets 120 (or other type of electric power outlet) enable standard electric devices (not shown) to be plugged into the sound-emitting device 100. The sound-emitting device 100 can be configured to allow electrical pass-through between the three-prong outlets 120 (or other type of power outlet) and a corresponding source of electric power to which the wireless sound-emitting device 100 is coupled, such as an outlet similar to electrical outlet 30, or an electric back-box box. The status LED 131 can, for example, illuminate when the wireless sound-emitting device 100 receives power or when the wireless sound-emitting device 100 is emitting a sound. In one embodiment, for example, the status LED 131 can illuminate different colors corresponding to different sounds being emitted, or selected to be emitted, from the loudspeaker (not shown). In some embodiments, the status LED can illuminate when the wireless sound-emitting device 100 is wirelessly connected to a wireless controller (not shown) or in response to any other operation condition. The status LED 131 can also function as a night light. In addition, it should be appreciated that other buttons may be present on the device 100 to permit a user to manually implement, on the device 100, any of the controls of the device 100 that are taught herein as being able to be implemented remotely.

FIG. 2B shows the rear of the wireless sound-emitting device 100 in accordance with an embodiment of the invention, which includes a rear panel 140 and two standard three prong electric plugs 121 (or other type of electric plug) positioned to interface with a true log standard 110 V outlet (shown as electric outlet 30 in FIG. 1), or other type of power outlet. Also shown are fasteners 141 securing the rear housing, i.e. back panel 140 and peripheral panels 111, to the front panel 130 of the wireless sound-emitting device 100. The protective grille 110 and corresponding loudspeaker can be positioned adjacent to, or near to, the rear panel 140 and this placement enables the loudspeaker to emit acoustic signals 22 in close proximity to the wall 20 and in a direction parallel to the wall 20 when the housing of the wireless sound-emitting device 100 is coupled to the wall. In an exemplary embodiment, the wireless sound emitter 100 has dimensions of 4.7 inches tall.times.3.0 inches wide.times.1.0 inch deep, exclusive of the three prong electrical plugs' 121 (or other type of plugs') extension beyond the rear panel 140. The wireless sound-emitting device 100 can, for example, extend less than about two inches from the surface of a wall on which it is installed (exclusive of its plugs) and can be less than about five inches in size in its largest dimension. The nearest edge of the aperture of the loudspeaker can, for example, be less than about 1 centimeter, such as less than about 0.5 centimeters or less than about 0.3 centimeters, from the surface of the wall.

Figure 3:
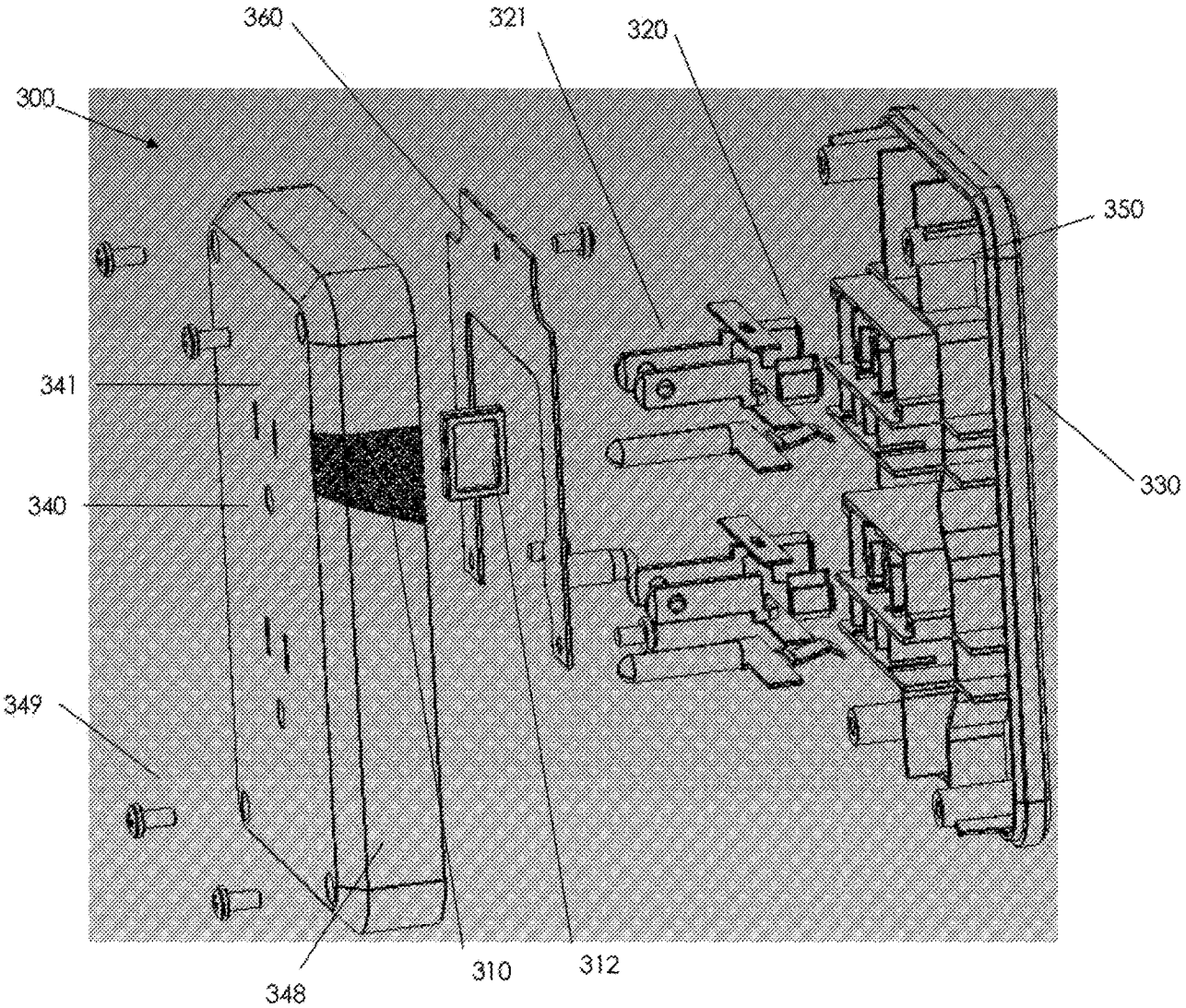
FIG. 3 is an exploded-view illustration of a wireless sound-emitting device embodiment.

FIG. 3 is an exploded-view illustration of a wireless sound-emitting device embodiment. FIG. 3 shows the interior of wireless sound-emitting device 300 including a loudspeaker 312, an acoustic chamber bounded by at least a portion of an acoustic enclosure 350, and an integrated circuit board 360. The loudspeaker 312 can be a circular cone loudspeaker or a rectangular panel-type loudspeaker 312, as shown in FIG. 3. The loudspeaker 312 comprises a driver in electrical connection with the integrated circuit board 360 and the loudspeaker is positioned behind the protective grille screen 310. As shown, the front panel 330 includes interior projections for mating with the rear panel 340 and a section of these projections form an acoustic enclosure 350 behind the loudspeaker 312. The acoustic enclosure 350 defines a volume of space (the acoustic chamber) behind the loudspeaker 312 and can be a sealed or ported enclosure to improve the acoustic characteristics of the loudspeaker 312, for example, the frequency range, frequency response, or sensitivity. The integrated circuit board 360 can include a digital processor, a digital storage module, wireless communications module, and a digital-to-analog converter. Fasteners 349 secure the rear panel 340 and peripheral panels 348 to the front panel 330. The rear panel 340 also includes holes 341 for the three-pronged plugs 321 to pass through. Also shown is the three-pronged plugs 321 (which may be another type of plug) in a pass-through (i.e., directly connected) configuration with the corresponding three-pronged outlets 320 (or other corresponding outlets) accessible through the front face 350.

Figure 4:
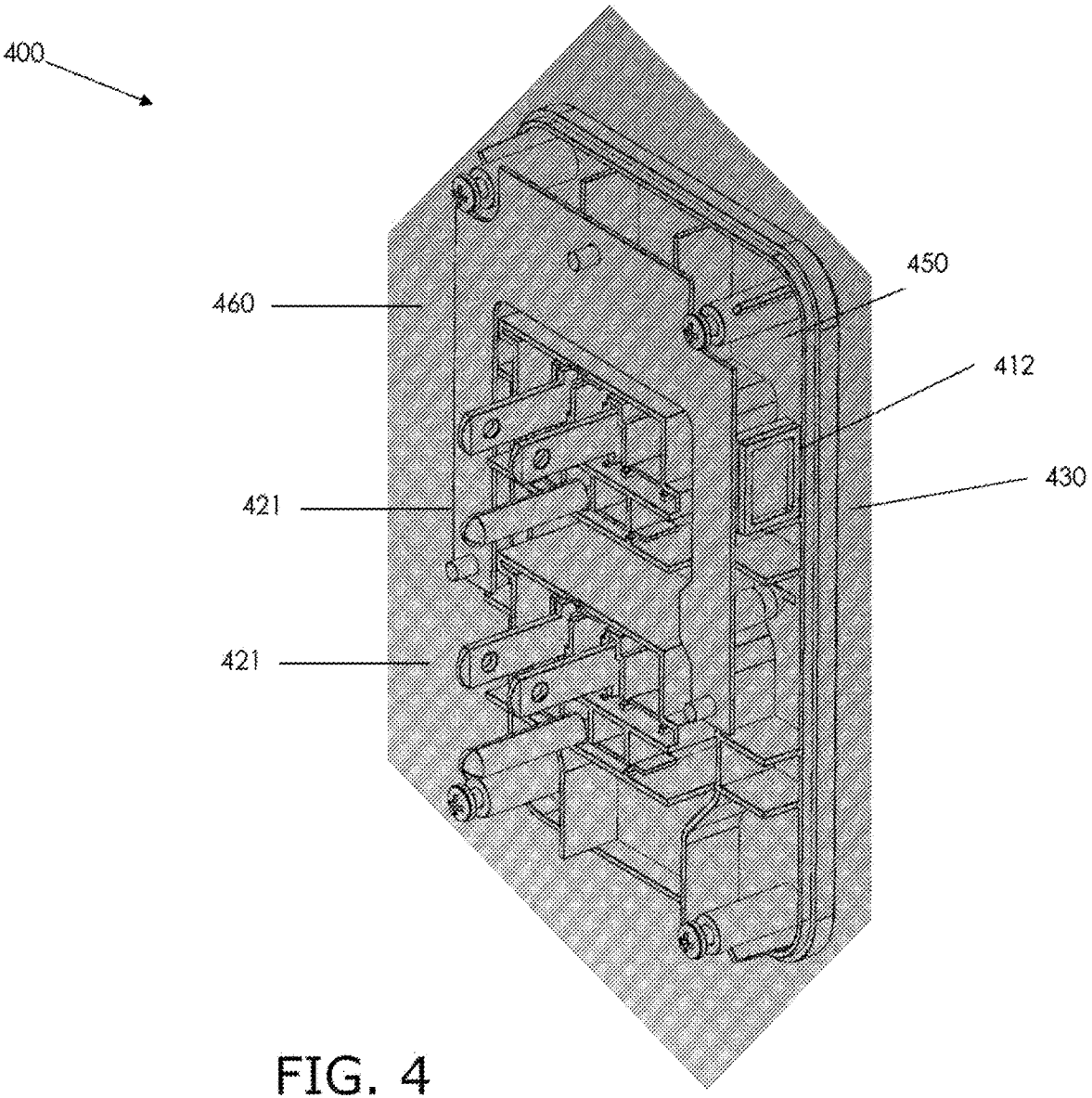
FIG. 4 is a rear isometric view illustration of a wireless sound-emitting device embodiment with a rear cover removed.

FIG. 4 is a rear isometric view illustration of a wireless sound-emitting device embodiment with a rear cover removed. FIG. 4 shows a wireless sound-emitting device 400 with a rear panel removed to show internal details of the components of FIG. 3, in an installed configuration. An integrated circuit board 460 is secured to the front panel 430 and a loudspeaker 412 is in electrical connection with the integrated circuit board 460 and positioned with an acoustic enclosure 450 defining a volume of space behind, and acoustically coupled with, the loudspeaker 412. The integrated circuit board 460 is also electrically connected with the three-pronged (or other format) electric plugs 421 protruding from the rear of the wireless sound-emitting device 400. In an alternate embodiment, with the wireless sound-emitting device being configured to interface with an electric back-box, the three-pronged (or other format) electric plugs 421 can be replaced with terminals for directly connecting the front electric outlets (12 of FIG. 2A) to the electric wiring of the electric back-box.

Figure 5:
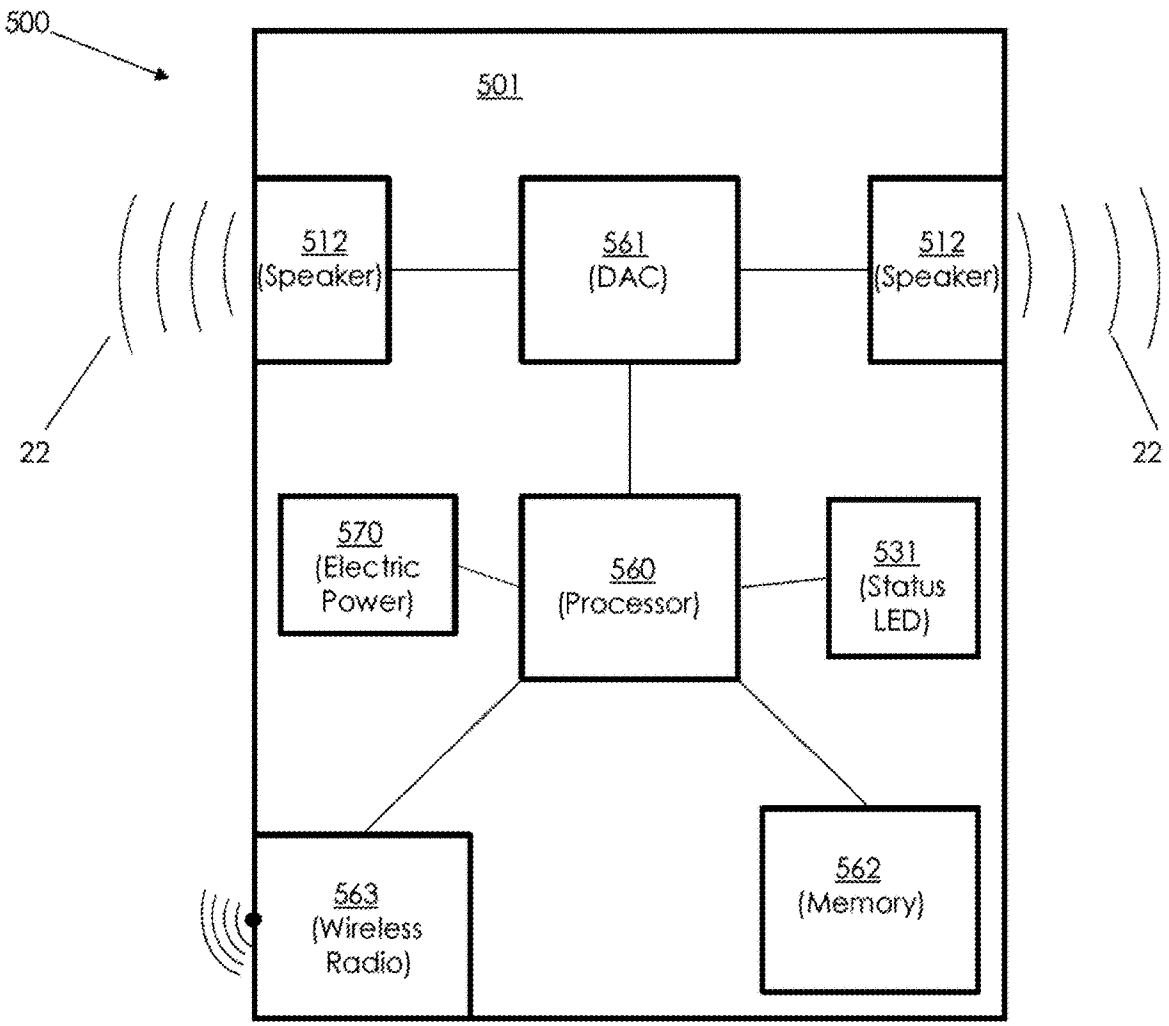
FIG. 5 is a schematic of the components of a wireless sound-emitting device embodiment.

FIG. 5 is a schematic of the components of a wireless sound-emitting device embodiment. The wireless sound-emitting device 500 includes a processor 560 with a digital-to-analog (DAC) converter 561; a digital memory module 562; a wireless communications radio 563, which can be, for example, a Wi-Fi component; an electric power connection 570; at least one status LED 531; and two or more loudspeakers 512. The processor 560 is an example of a "control module" of the wireless sound-emitting device, as used herein, in accordance with an embodiment of the invention. The loudspeakers 512 can be small-driver units of less than about 3 cm in diameter or largest aperture dimension, such as small-driver units produced by Ole Wolff Elektronik A/S of Soroe, Denmark, and receive analog electric signals from the DAC 561 to drive the loudspeakers 512 and produce acoustic signals 22. The processor 560 receives electric power from the electric power connection 570 and is in electric communication with the memory 562, wireless radio 563, the status LEDs 531, and the DAC 561. The processor 560 can be configured to receive operational instructions transmitted wirelessly to the wireless sound-emitting device 500 and received by the wireless radio 563. These instructions can be transmitted via any wireless protocol. The processor 560 can receive stored digital sound data from the memory 562 and decode the sound data prior to sending a corresponding digital signal to the DAC 561, which sends a corresponding analog signal to the loudspeakers 512 to emit acoustic signals 22 corresponding to the stored digital sound data. The processor 560 can also instruct the DAC 561 to produce a sound-masking sound by generating a digital sound-profile or retrieving stored sound masking data from the memory 562. Additionally, the processor 560 can stream digital audio data received from the wireless radio 563 to the DAC 561 to be emitted as acoustic signals 22 corresponding to the received streaming data. In one example, the digital audio data to be streamed can be a paging signal, so that the wireless sound-emitting device 500 can act as a wireless paging system using the paging signal. Other digital audio data can be streamed, including music and other audio signals.

Figure 6:
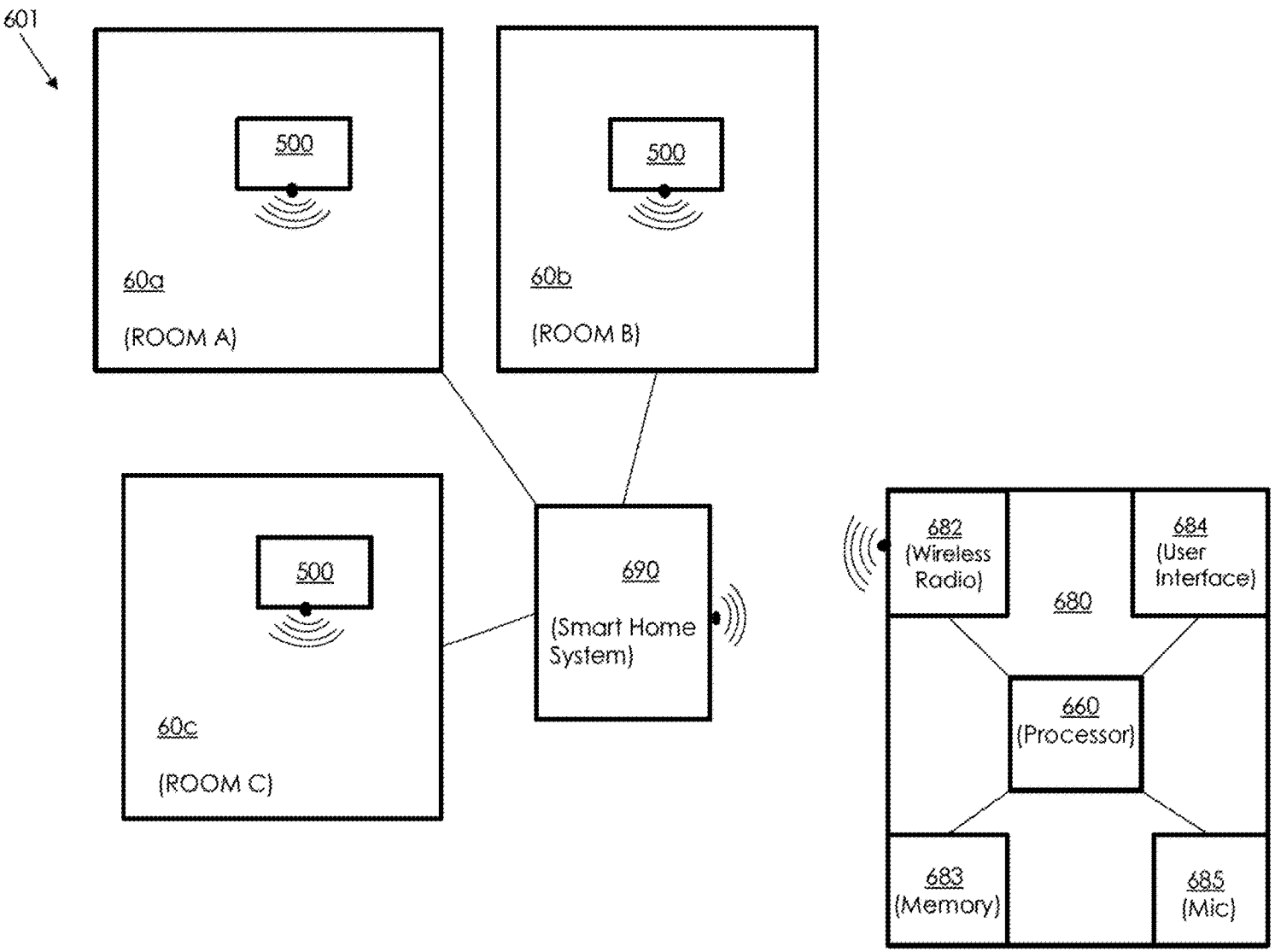
FIG. 6 is a schematic of the components of a system for remote operate of a wireless sound-emitting device embodiment.

FIG. 6 is a schematic of the components of a system for remote operation of a wireless sound-emitting device embodiment. FIG. 6 shows three rooms 60*a-c* each having a wireless sound-emitting device 500. One or more of the wireless sound-emitting devices 500 in the rooms 60*a-c* can have a connection to a smart home system or home automation system 690. The smart home system 690 can, for example, be a Crestron® system (sold by Crestron, Inc. of Rockleigh, N.J., U.S.A.) or a system using the Wink platform (sold by Flextronics Ltd. of Singapore). The smart home system 690 can be used to control elements in the rooms 60*a-c* such as, for example, the lights, heating or an alarm system (not shown), and can also be in communication with one or more of the wireless sound-emitting devices 500 and a wireless control device 680. A wireless control device 680 is shown and can be, for example, a tablet computer or smartphone, enabling wireless communication with the wireless sound-emitting devices 500 and, using a smart home system-specific API, with the smart home system 690. The wireless control device 680, which is an example of what is referred to herein as a "wireless controller," includes a processor 660 in electric communication with a wireless radio 682, a digital storage module such as a memory 683, a user interface 684 and a microphone 685. The wireless controller can be or include a portable computer device, such as a tablet computer or smartphone; a desktop computer; a device including application specific integrated circuits; or any other specially programmed computer device. In one example, the wireless controller is a device running an iOS or Android operating system, such as an iPad, iPhone or other similar tablet or smartphone device (iOS, iPad and iPhone are marks of Apple Inc. of Cupertino, Calif., U.S.A.; Android is an operating system of Google Inc. of Mountain View, Calif., U.S.A.). It will be appreciated that a "wireless controller," as used herein, can include more than one device, or one or more components of more than one device, working together (including via wireless communication with each other) to perform one or more of the functions of a wireless controller as used herein.

In accordance with an embodiment of the invention, the processor 660 can be running, for example, a smartphone operating system environment, and can further be running an application in the smartphone operating system to provide a user interface 684 to a display of the wireless control device 680. The user interface can enable a user to interact with the wireless control device 680, e.g., using a touch-screen display, to control the operation of one or more of the wireless sound-emitting devices 500. In one embodiment, the user interface 684 enables a user to see, and to change, a status of each wireless sound-emitting devices 500 as on or off, to change a volume level of each wireless sound-emitting device 500, to start or stop sound-emitting from each wireless sound-emitting devices 500, to select a sound file to be played by one or more wireless sound-emitting devices 500, or to issue a paging address, recorded by the microphone 685, to one or more of the wireless sound-emitting devices 500. Additionally, the user interface 684 can enable a user to control groups of wireless sound-emitting devices 500, for example, by creating a group for all the wireless sound-emitting devices 500 in a given room, e.g., room 60*a*, and issuing commands to all the wireless sound-emitting devices 500 of that given room 60*a*. The user interface 684 can, for example, be used to control the wireless sound-emitting devices 500 by areas within a dwelling or other building (e.g. an east wing or west wing of an apartment or hotel), by user groups, by rooms, and by the individual device. In some embodiments, the wireless control device 680 is connected to the Internet and a user can access streaming audio data via the Internet and wirelessly stream the audio data to the wireless sound-emitting devices 500.

Figure 7:
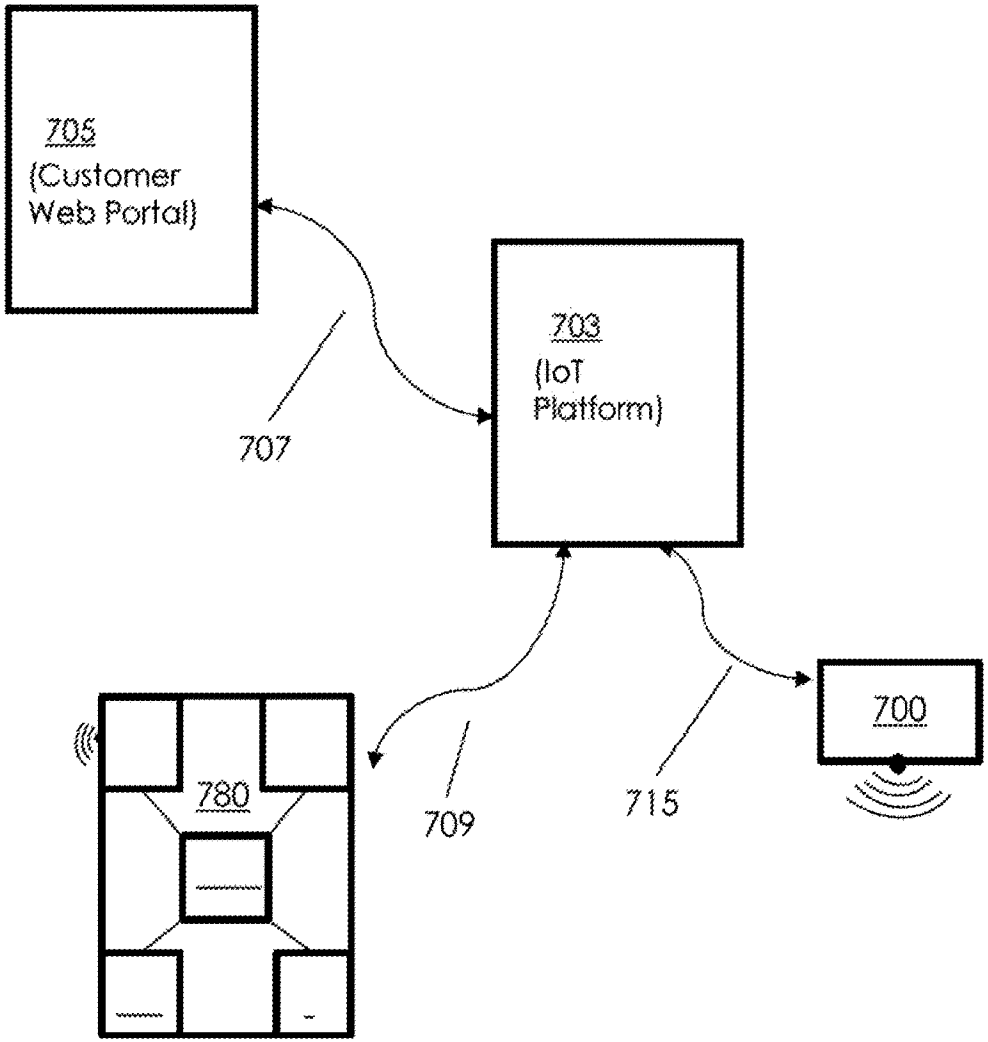
FIG. 7 is a schematic diagram of a system in accordance with an embodiment of the invention, in which a wireless sound-emitting device can be controlled remotely, via a customer portal, through an Internet of Things (IoT) platform.

FIG. 7 is a schematic diagram of a system in accordance with an embodiment of the invention, in which a wireless sound-emitting device 700 can be controlled remotely, via customer portal 705, through an Internet of Things (IoT) platform 703. In this embodiment, a user accesses a customer portal 705, for example implemented as a software application accessible over the Internet, to remotely control a wireless sound-emitting device 700 in accordance with an embodiment of the invention. The customer portal 705 is linked to the IoT platform 703 via a web link 707 or other communications network link. The customer portal 705 may, for example, be implemented as a website; and may, for example, be a multi-tenancy application. The IoT platform 703 may, for example, be implemented using a software application that is resident on a cloud computing network, such as over the Internet. The IoT platform 703 is, in turn, in communication with the wireless sound-emitting device 700 via a wireless communications link 715; and is also in communication with the user's wireless control device 780, such as a smartphone or tablet device, via wireless communications link 709. The wireless sound-emitting device 700 communicates with the wireless control device 780, as in other embodiments set forth herein, via a wireless communications link, such as WiFi or via a short distance wireless communications link, such as a Bluetooth communications link.

In use of the embodiment of FIG. 7, a user is, for example, able to control the wireless sound-emitting device 700 by interacting with a user interface (684 of FIG. 6) on the wireless control device 780; the user's interactions can be communicated to the IoT platform 703 via wireless link 709; and the IoT platform 703 can push the user's control commands to the wireless sound-emitting device 700 to control the device 700 in any of the ways taught herein. Alternatively or in addition, the user can control the device 700 using the customer portal 705, which communicates the user's control commands to the IoT platform 703 over link 707; and the IoT platform 703 in turn pushes the user's control commands to the sound-emitting device 700. The user can use the customer portal 705 or wireless control device 780 to remotely control the wireless sound-emitting device 700 via the IoT platform 703. For example, the volume of the sound emitted from device 700 can be controlled; the user can select the sound to be emitted from device 700; the user can control the scheduling of operation of the device 700; the user can control the ramp-up time and ramp-down time for emitting sound from the device 700; and the user can control groups, rooms, and individual devices in a building, as taught elsewhere herein. Further, a status indicator light (such as a night light or any other status indicator light taught herein) on the wireless sound-emitting device 700 can be remotely controlled by the user, either over the customer portal 705 or the wireless control device 780, via the IoT platform 703, to adjust the color, intensity, or schedule of operation of the status indicator light.

In addition, in accordance with an embodiment of the invention, the IoT platform 703 can be in communication with other Internet of Things (IoT) devices, for example via a cloud computing network, which IoT devices (not shown) can thereby communicate (in either direction) with the wireless control device 780 and the wireless sound-emitting device 700, via the IoT platform 703. For example, an IoT device for managing other home systems (such as the home's heat) can communicate to the wireless control device 780 that a resident of the home is away, in response to which the wireless control device 780 can schedule the wireless sound-emitting device 700 to be inactive while the resident is away. Or an alarm IoT device can communicate to the wireless control device 780 that an alarm is being activated, in response to which the wireless control device 780 can control a status indicator light on the wireless sound-emitting device 700 to be a certain color, or can control the device 700 to be muted.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. A wireless sound-emitting device, comprising:

a housing, the housing comprising a front face and a rear face, the front face having at least one electric socket, the rear face of the housing comprising at least one corresponding electric plug, wherein the at least one electric socket is configured to pass-through an electric power signal to the corresponding electric plug such that the housing presents a standard electric outlet;

at least one loudspeaker adapted to emit acoustic signals;

a control module in electrical communication with the at least one loudspeaker to drive the at least one loudspeaker with an electric audio signal comprising a sound-masking signal; and a wireless communications module in electrical communication with the control module.

2. The wireless sound-emitting device of claim 1, further including:

a memory module in electrical communication with the control module, the memory module storing digital sound files comprising the at least one digital sound signal; and the control module being further adapted to convert the at least one digital sound signal comprised in the digital sound files into the electric audio signal to drive the at least one loudspeaker.

3. The wireless sound-emitting device of claim 1, further including:

the wireless communications module being adapted to wirelessly receive digital sound data comprising the at least one digital sound signal; and the control module being further adapted to convert the at least one digital sound signal comprised in the wirelessly received digital sound data into the electric audio signal to drive the at least one loudspeaker.

4. The wireless sound-emitting device of claim 1, further including:

one or more status indicator lights, each of the status indicator lights being responsive to a status of one or more of: the at least one loudspeaker, the control module, a source of electric power, and the wireless communications module.

5. The wireless sound-emitting device of claim 4, wherein the one or more status indicator lights is adapted to emit light in a direction parallel to a surface of a wall when the at least one electric plug is coupled to an outlet in the wall.

6. The wireless sound-emitting device of claim 1, further including:

an acoustic enclosure acoustically coupled to a rear end of the at least one loudspeaker.

7. The wireless sound-emitting device of claim 6, wherein the acoustic enclosure is a sealed or ported enclosure.

8. The wireless sound-emitting device of claim 1, wherein the at least one loudspeaker has a largest aperture dimension of less than about 3 centimeters.

9. The wireless sound-emitting device of claim 1, wherein the housing further including a protective grille covering the at least one loudspeaker.

10. A system for managing the sound environment of one or more rooms, the system including:

at least one wireless sound-emitting device, the at least one wireless sound-emitting device comprising:

a housing, the housing comprising a front face and a rear face, the front face having at least one electric socket, the rear face of the housing comprising at least one corresponding electric plug, wherein the at least one electric socket is configured to pass-through an electric power signal to the corresponding electric plug such that the housing presents a standard electric outlet;

at least one loudspeaker adapted to emit acoustic signals;

a control module in electrical communication with the at least one loudspeaker to drive the at least one loudspeaker with an electric audio signal comprising a sound-masking signal; and a wireless communications module in electrical communication with the control module; and a wireless controller in wireless communication with each wireless sound-emitting device of the at least one wireless sound-emitting device.

11. The system of claim 10, further including:

the wireless controller having an application program interface (API) to communicate electronically with a smart home system, the API enabling the smart home system to control operation of the at least one wireless sound-emitting device.

12. The system of claim 10, further including:

the wireless controller enabling remote control of at least one of the following of the wireless sound-emitting device: volume of the at least one loudspeaker, turning the device on or off, selection of an sound or audio file to be played, turning on or off emitting of a sound masking sound, and scheduling of operation of the wireless sound-emitting device.

13. The system of claim 10, further including:

the wireless controller having a microphone to record a spoken paging address, the wireless controller adapted to stream the recording to the at least one wireless sound-emitting device and to cause the at least one loudspeaker to emit the paging address.

14. The system of claim 10, wherein the wireless controller is a portable computer device having an application for controlling the operation of the at least one wireless sound-emitting device, the application providing a user interface on a display screen of the portable computer device.

15. The system of claim 10, wherein the wireless controller is adapted to enable remote control of the at least one wireless sound-emitting device from a customer portal.

16. The system of claim 10, wherein the wireless controller is adapted to enable remote control of the at least one wireless sound-emitting device via an Internet of Things platform.

17. The system of claim 16, wherein the wireless controller is adapted to enable communication of the at least one wireless sound-emitting device with at least one other Internet of Things device via the Internet of Things platform.

18. The system of claim 17, wherein the wireless controller is adapted to enable communication from the at least one wireless sound-emitting device to the at least one other Internet of Things device via the Internet of Things platform.

19. The system of claim 17, wherein the wireless controller is adapted to enable communication to the at least one wireless sound-emitting device from the at least one other Internet of Things device via the Internet of Things platform.

20. The system of claim 16, wherein the wireless controller is adapted to enable control of the at least one wireless sound-emitting device by at least one other Internet of Things device.

* * * * *